United States Patent [19]

Marchio et al.

[11] 3,942,735

[45] Mar. 9, 1976

[54] VIEWING TABLE

[75] Inventors: Douglas R. Marchio, Concord; Marino J. Marchio, Antioch, both of Calif.

[73] Assignee: Levi Strauss & Co., San Francisco, Calif.

[22] Filed: Dec. 26, 1974

[21] Appl. No.: 536,334

[52] U.S. Cl. ..... 242/56 R; 242/57.1; 242/74; 242/76

[51] Int. Cl.[2] ..... B65H 19/20; B65H 25/26

[58] Field of Search ..... 242/56 R, 67.1 D, 67.3 R, 242/76, 57.1, 74; 28/70; 240/2 D; 226/196, 198

[56] References Cited

UNITED STATES PATENTS

| | | | |
|---|---|---|---|
| 745,424 | 12/1903 | Davis | 242/67.1 D |
| 2,622,448 | 12/1952 | Lorig | 226/196 X |
| 2,635,826 | 4/1953 | Kyzinski | 242/57.1 |
| 2,643,326 | 6/1953 | Knapp | 240/2 D |
| 2,895,511 | 7/1959 | Sehman | 242/74 X |
| 2,936,506 | 5/1960 | Butler | 26/70 |
| 2,989,265 | 6/1961 | Selsted | 242/76 |
| 3,338,488 | 8/1967 | Hunt | 242/67.3 R X |
| 3,759,456 | 9/1973 | Moneagle | 242/57.1 |

*Primary Examiner*—Edward J. McCarthy
*Attorney, Agent, or Firm*—Limbach, Limbach & Sutton

[57] ABSTRACT

A web of material is drawn by the machine from a removable supply roll over a first self-centering pulley, across a flat reviewing surface, over a second set of self-centering pulleys arranged in a figure S fashion, and is wound on a removable takeup shaft. Cutting means are provided for severing the portion of the web wound on the takeup shaft from the remainder of the web, and motor driven means are provided for selectively driving either the takeup shaft forwardly or the supply roll rearwardly in order to collate different web segments on one or more takeup shafts.

10 Claims, 6 Drawing Figures

VIEWING TABLE

BACKGROUND OF THE INVENTION

The present invention relates to a machine for drawing a web of material across a reviewing surface and more particularly to such a machine wherein segments of the web may be collated on separate shafts.

It is desirable in some industries, particularly the garment industry, to provide a device for reviewing, correcting, separating and collating rolled graphic material, for example, computer generated cutting patterns, or to review and patch hectographic carbon paper, which is expensive, for later reuse. It is also necessary in such a machine to provide means for winding and rewinding the web of material and for straightening disheveled rolls of material.

In order to collate the segments of the rolled web material, means must be provided by which a plurality of takeup shafts may be conveniently interchanged. The different web segments are severed and wound on these separate takeup shafts and, in some case, are re-inserted into the continuous web by patching at a different location along the web. When segments are cut, the web must be prevented from unraveling from the supply roll. The machine also must adequately control the tension in the web of material as it passes over the reviewing surface and furthermore the web must be centered at all times in passing through the machine or else the edges of the web become torn or frayed.

SUMMARY OF THE INVENTION

The above and other requirements are met by the present invention of a machine for drawing a web of material along a predetermined path from a supply roll across a reviewing surface and for winding it on a batching roll, the invention comprising an upright frame, a supply roll shaft, means for removably mounting the supply roll shaft on the upright frame at one end of the path of web travel, a substantially flat reviewing surface supported by the frame, a first self-centering web feed pulley rotatably mounted on the frame between the supply roll shaft and the reviewing surface along the path of web travel and a takeup shaft removably mounted on the frame at the other end of the path of web travel for supporting the batching roll.

A second self-centering pulley is rotatably mounted on the frame between the reviewing surface and the takeup shaft along the path of web travel. Motor means are provided for selectively driving the takeup shaft to draw the web in a forward direction along the path or alternatively to drive the supply shaft to draw the web of material in the reverse direction along the path. Cutting means are provided for severing segments of the web from the remainder of the material which are then wound on the batching roll.

In one preferred embodiment a third self-centering pulley is spaced from the second self-centering pulley so that the web of material is diverted in a figure S pattern during its travel along the path. The supply shaft is fitted with a gear at one end and is supported by a pair of spaced apart guide rails which are generally parallel to the direction of the path traveled by the web. The supply shaft is rolled into engagement with a first driving gear rotatably mounted on the frame. The first driving gear is selectively connected to motor means when it is desired to drive the web of material in the reverse direction. Succeeding web segments are prevented from unraveling from the supply roll during the collation process by means of a brake upon the supply roll.

In the preferred embodiment the reviewing surface is translucent and is backlighted. To allow for skew adjustment of the web material as it is wound on the takeup shaft, one end of the takeup shaft can be moved with respect to the other end. The takeup shaft mounting includes a pair of cones which are adapted to be inserted into cavities in the opposite ends of the takeup shaft. At least one of these cones is spring biased toward the other cone so as to resiliently hold the takeup shaft between them. One of the cones is also engaged by a driving gear to be selectively driven by the motor means in the forward direction.

In some preferred embodiments, the self-centering pulleys are provided with non-parallel grooves which converge in the direction of forward web travel so as to center the web. In some preferred embodiments, the covering of the self-centering pulleys is made of a resilient material while in other embodiments the self-centering pulleys do not rotate but instead are air bearings provided with a plurality of small nozzles which jet streams of air to support the web of material. The jets and a plurality of grooves are oriented along non-parallel lines which diverge in the direction of forward travel of the web.

The same amount of air is independently supplied to the right and left longitudinal halves of the surface (e.g., air bearing). If the web rides to the left, more air supply jets will be exposed on the right half of the air bearing. Hence, the air pressure on the right will drop and the right side of the moving web will ride harder on the grooves of the right side. Since the grooves are at an outward direction in reference to the direction of web movement, the web will dynamically center itself. The objective of this design is to minimize moving parts and provide a more responsive means for self-centering the web.

If a more stable means of keeping the paper centered when the web is reversed during the edit stage is desired, then the air bearing can be rotated to a flat side or if more precise centering is desired, it can be rotated to a side with grooves arranged to favorably center the paper in reverse. In other embodiments the air bearing can be simply dropped away from the paper during the reverse web travel or the air flow can be reversed through the air bearing. Rotation of the air bearing can be accomplished by a chain or ribbed belt and a crank or motor.

In an alternative embodiment an electro-stataic charge is placed on the plastic coated takeup shaft to anchor the web of material until the takeup roll is to be removed. At such time it is discharged by connection to a battery. In other embodiments the web of material is held by simple mechanical clips to the takeup shaft.

It is therefore an object of the present invention to provide a machine for reviewing and collating rolled, web material.

It is another object of the invention to provide a machine for segmenting rolled, web material and for rolling the segments onto different shafts.

It is still another object of the invention to provide a machine for reviewing rolled, web material wherein the web feeding means includes means for centering the rolled web material.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
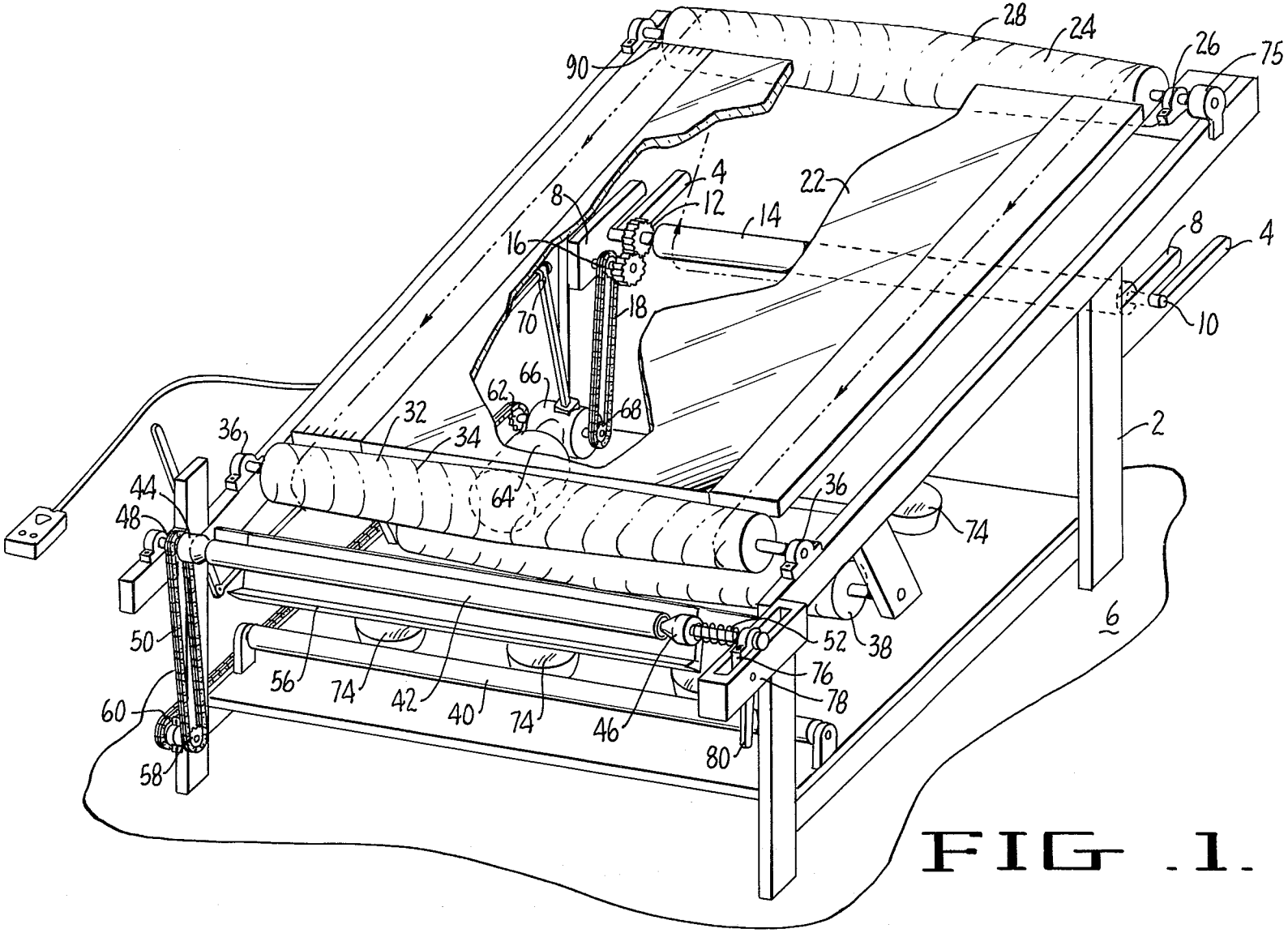
FIG. 1 is a perspective view of a reviewing machine according to one embodiment of the invention with portions broken away and prior to winding the web of material on the machine.

Referring now more particularly to FIG. 1, a generally rectangular, upright frame 2 supports a pair of parallel, spaced-apart, generally horizontal guide rails 4 at an elevated position from the floor 6. Each of the guide rails is provided with a stop member 8 at its end which is closest to the interior of the machine. The stop members 8 are in the form of upwardly extending hooks.

The purpose of the guide rails 4 is to removably support a supply shaft 10 between them. The supply shaft 10 is equipped with a first driving gear 12 spaced inwardly from one end (the left end as viewed in FIG. 1). A hollow rod 14 of webbed material 30 is snugly fitted onto the shaft 10. In operation the supply shaft 10, together with the supply roll 14, is placed across the outward ends of the guide rails 4 and rolled inwardly until it engages the hook-shaped stop members 8. When this happens the driving gear 12 also engages a gear 16 rotatably mounted on the frame 2 and driven by a chain 18 connected to a motor assembly 64 as will be explained in greater detail hereinafter.

The upright frame 2 also supports a substantially flat reviewing surface 20 which may be tilted from the horizontal for ease in viewing by the operator. The reviewing surface 20 is provided with a translucent panel 22 and is of a width which is approximately the same as the width of the web of material 30 wound on the supply roll 14. The length of the reviewing surface 20 may be any desired length. Between the supply shaft 10 and the end of the reviewing surface 20 which is closest to the supply shaft 10 is a self-centering pulley 24 whose shaft is rotatably mounted in bearing blocks 26 attached to the upright frame 2.

Figure 4:
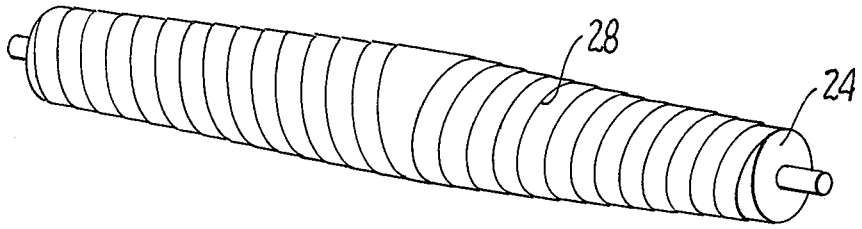
FIG. 4 is a perspective view of a self-centering pulley used in the embodiment of FIG. 1.

As best illustrated in FIG. 4, the self-centering pulley 24 is made by helically wrapping a straight, hollow pulley shaft with a stretched, elastic molding or tape 28 from each end of the pulley shaft with decreasing stretch toward its center so that the exterior surface of the pulley 24 is crowned from its longitudinal center and is provided with a plurality of resilient ridges. The ridges on one longitudinal half are non-parallel with the corresponding ridges on the other longitudinal half of the pulley 24. By longitudinal half is meant the half of the pulley which would lie on either side of a plane passing perpendicularly through the axis of rotation of the pulley at its midpoint. The term radial half is used to refer to the half of the pulley which would lie on either side of a plane passing through the axis of rotation of the pulley lengthwise and parallel to it. The ridges on the surface of the pulley 24 tend to converge in the direction of travel of the web 30 of material as it moves from the supply roll 14 over the self-centering pulley 24 in the forward direction.

At the opposite end of the reviewing surface 20 from the self-centering pulley 24 is a second self-centering pulley 32. The self-centering pulley 32 is constructed in substantially the same manner as the self-centering pulley 24 and has helical ridges 34 of resilient material on the exterior surface of the pulley 32 extending in opposite directions from its center towards its ends so that the ridges 34 on the opposite longitudinal halves of the pulley 32 converge in the direction of forward travel of the web 30. The shaft ends of the pulley 32 are rotatably mounted in bearing blocks 36 on the frame 2.

Figure 2:
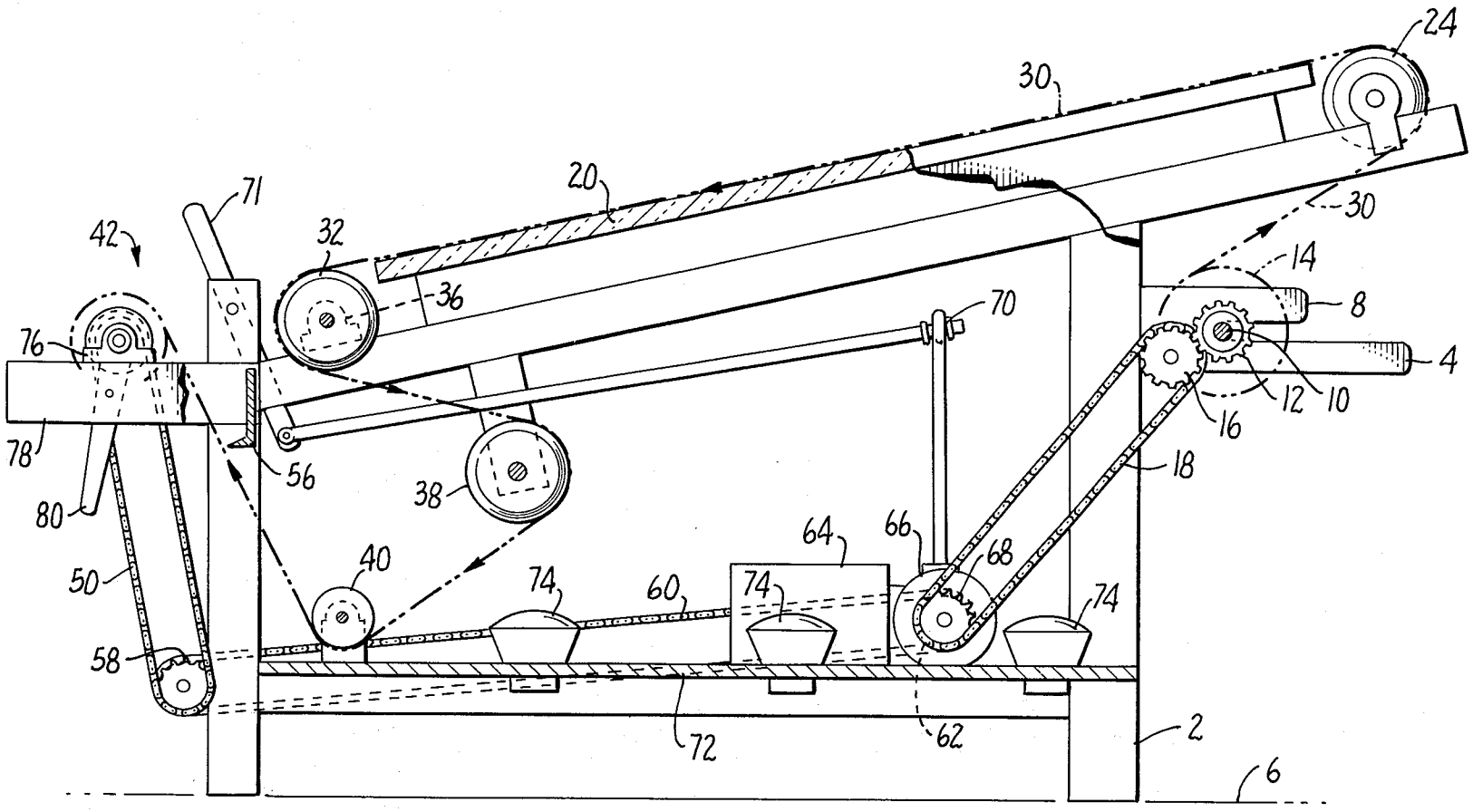
FIG. 2 is a reduced, side view in elevation of the machine illustrated in FIG. 1.

As best shown in FIG. 2, a third self-centering pulley 38 is mounted between the self-centering pulleys 24 and 32 and below the reviewing surface 20. The self-centering pulley 38 is constructed in substantially the same manner as the self-centering pulleys 24 and 32. The path of travel of the web 30, as shown more clearly in FIG. 2, is in the form of an S. After leaving the surface of the self-centering pulley 38, the web passes beneath and around an idler roller 40 and then up to a hollow takeup shaft 42.

Figure 3:
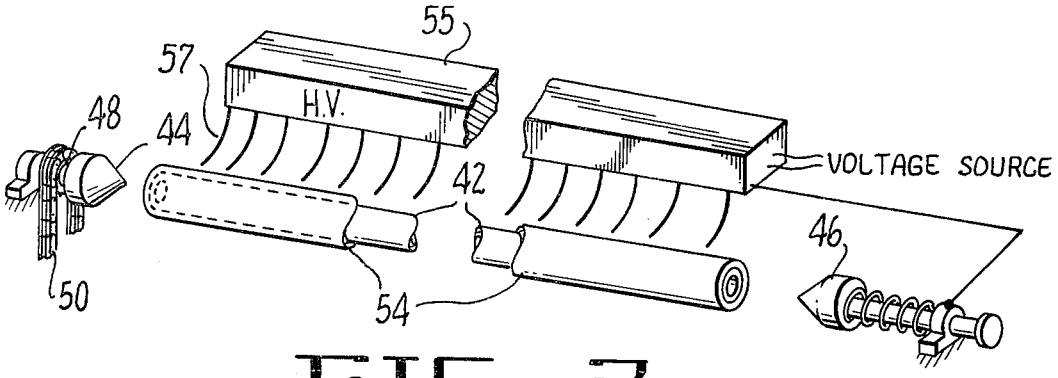
FIG. 3 is an enlarged, exploded view in perspective of the takeup shaft of the machine of the embodiment of FIG. 1.

A pair of cones 44 and 46 are rotatably mounted on the frame 2 and are pressed into separate ends of the shaft 42 by means of a compression spring 52. The cone 44 is connected to a driving gear 48 driven by a driving chain 50. As best shown in FIG. 3, in practice, the takeup shaft 42 is removed from the machine by pulling the cone 46 away from the end of the shaft 42.

A core 54 is then snugly fitted over the exterior of the shaft 42. The length of the core 54 is substantially the same as the length of the shaft 42 so that the ends of the core 54 are engaged by the cones 44 and 46 when the shaft and the core are remounted in the machine. The end of the web 30 is attached to the core 54 by friction wrap, adhesive tape, metal clips, or in one embodiment, by electrostatically charging the core 54, which is made of an insulated material, by means of a high voltage source 55 which has corona discharge elements 57 placed adjacent the core 54 and is grounded to the machine. (See FIG. 3.) A V-shaped tearoff cutter 56 is pivotally mounted on the frame 2 along the path taken by the web of material between the idler roller 40 and the takeup shaft 42.

Referring now more particularly to FIG. 2, the driving chain 50 passes from the driving gear 48 around a second driving gear 58 rotatably mounted at the bottom of the frame 2. Another driving chain 60 is also engaged with the driving gear 58 and an output driving gear 62 of a motor assembly 64. The motor assembly 64 is connected to the output driving gear 62 through a clutch 66. The driving chain 18 for the gear 16 is connected to a second output driving gear 68 which is connected to the motor assembly 64 through the clutch 66. A linkage assembly 70 connected to a lever arm 71 at one end of the reviewing table controls which of the driving gears 62 or 68 is connected to the motor 64. Gears 62 and 68, which are connected to the motor assembly 64, only in the alternative through the clutch 66, rotate in opposite directions so that the web of material may be pulled in a forward direction when the driving gear 62 is connected between the takeup shaft 42 through the chains 60 and 50 and the motor 64. Likewise, when the driving gear 68 is connected to the motor assembly 64 through the clutch 66 the driving gear 68, through the driving chains 18, causes the supply shaft 10 to rotate in a direction such that the web 30 is pulled in a reverse direction across the reviewing surface 20.

A platform 72 is mounted on the frame 2 beneath the reviewing surface 20. A plurality of lights 74 are mounted on the platform 72 and are directly upwardly at the bottom of the translucent panel 22 to furnish backlighting for the web passing over the reviewing surface 20.

In order to maintain a substantially constant tension on the web 30 as it is being drawn across the reviewing surface 20, a braking mechanism 75 is connected to one end of the shaft of the first centering pulley 24. The braking mechanism 75 provides an adjustable, constant drag on the rotation of the centering pulley 24. In other embodiments a differential gearing mechanism is substituted for the clutch 66 to provide a constant differential torsion between the driving gears 62 and 68 in order to maintain a constant tension in the web 30. In still other embodiments electronic circuits which measure the power supplied to the motor 64 control it so that a constant tension is applied to the web 30.

In order to correct for misalignment of the web 30 with the takeup shaft 42, a skew adjustment is necessary. The cone 46 is rotatably mounted in a bearing block 76 which is slidably mounted on a cross member 78 of the frame 2. A lever 80 is pivotally attached to the slidable bearing block 76 to allow the horizontal position of the bearing block to be adjusted with respect to the crosss member 78. In this way, the relative angle between the takeup shaft 42 and the web of material 30 being wound thereon may be adjusted and the skew of the web 30 as it is wound on the takeup shaft 42 may be varied. The reviewing table 20 has registration marks at one or both ends to aid in initially centering the web of material before collation.

Figure 5:
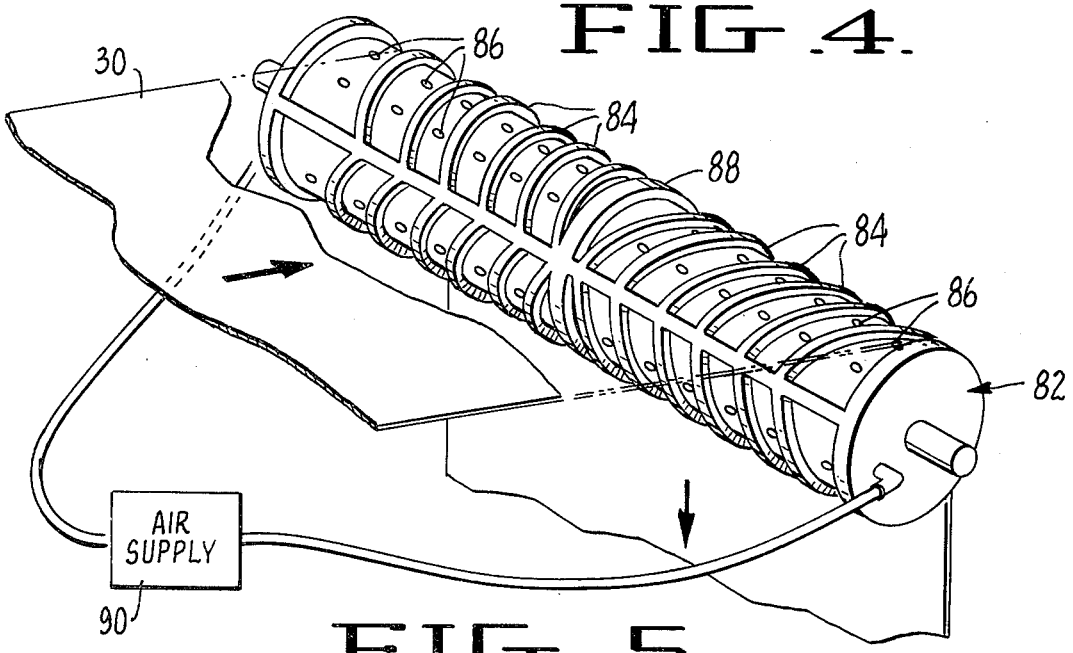
FIG. 5 is a perspective view, with portions broken away, of a self-centering pulley according to another embodiment of the invention.
Figure 6:
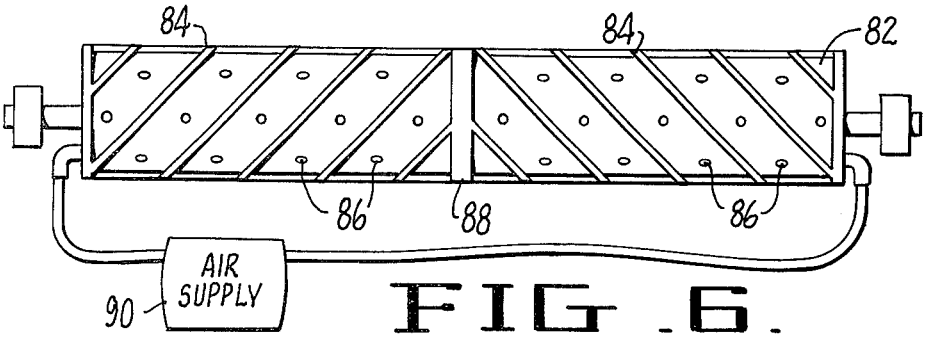
FIG. 6 is a side view in elevation of the pulley of the embodiment of FIG. 5 together with air pressure generating apparatus.

Referring now more particularly to FIGS. 5 and 6, an alternative embodiment of the self-centering pulley is illustrated. In this embodiment, a self-centering pulley 82, which may be substituted for the pulleys 24, 32 and 38 above, is equipped with a helical ridge 84 which, as in the cases of the self-centering pulleys 24, 32 and 38, has a a right hand lay on one longitudinal half of the pulley and a left hand lay on the other longitudinal half of the pulley. The surface of the pulley 82 has a plurality of holes 86 therein between the ridges 84. This combination of holes and grooves essentially constitutes a grooved air bearing with air being supplied from an external source 90 through the holes 86 to the underside of the web of material riding on the surface. A raised airtight baffle 88 is located around both the middle (lengthwise) and the center of the pulley surface. The same amount of air is independently supplied to the right and left longitudinal half surfaces from an external source 90. If the paper rides to the left, more air supply holes will be exposed on the right longitudinal half of the air bearing, hence, the air pressure on the right will drop and the right side of the moving paper will ride harder on the right side ridges 84. The ridges 84 on the right side of the pulley 82 diverge with respect to the ridges 84 on the left side of the pulley 82 in the direction of normal travel of the web 30. Hence as the web 30 rides harder on the ridges of one side or the other the paper will dynamically center itself.

In one embodiment, the pulley 82 has ridges 84 as shown in FIG. 5 on one radial half of its surface while on the other radial half of its surface, that is when the pulley 82 is rotated 180° with respect to the position shown in FIG. 5, the ridges are oriented to diverge in the opposite direction. This allows the pulley 82 to be used in both the forward and the reverse directions merely by rotating the pulley 82 such that the ridges 84 have the proper orientation for centering with respect to the direction of web travel.

While in the above described embodiment, the skew control was described as being manually operated, in other embodiments the skew control may be varied automatically by an edge guide monitoring device which controls an appropriate actuator to move the bearing block 76.

In some embodiments, a side portion of the reviewing table 20 is hinged or can be slid away to allow access by the operator to the self-centering pulleys in order to thread the web of material through the machine.

Although the specific web material has not been designated in detail, it is contemplated that the machine may be adapted for reviewing computer-plotter output (in rolled forms) and more specifically to review hectographic carbon paper pattern markers in the garment industry. It is especially useful since the roll of paper would otherwise have to be manually unrolled, cut apart and re-rolled. The machine is useful for many other applications, however, and it is not intended to limit the scope of the invention specifically to computer plotter reviewing.

The terms and expressions which have been employed here are used as terms of description and not of limitation, and there is no intention, in the use of such terms and expressions, of excluding equivalents of the features shown and described, or portions thereof, it being recognized that various modifications are possible within the scope of the invention claimed.

What is claimed is:

1. A reviewing and collating machine for drawing a web of material along a predetermined path from a supply roll across a flat reviewing surface and winding it on a batching roll, comprising an upright frame, a supply roll shaft, means for rotatably and removably mounting the supply roll shaft on the upright frame at one end of the predetermined path, a substantially flat reviewing surface supported by the frame, a first self-centering web feed pulley rotatably mounted on the frame between the supply roll shaft and the reviewing surface along the predetermined path of travel of the web of material, a takeup shaft for supporting the batching roll, means for rotatably and removably mounting the takeup shaft on the frame at the other end of the predetermined path, a second self-centering pulley rotatably mounted on the frame between the reviewing surface and the takeup shaft along the predetermined path, means for selectively driving either the takeup shaft to draw the web of material in a forward direction along the predetermined path or the supply shaft to draw the web of material in the opposite direction along the predetermined path, and means for severing the batching roll from the remainder of the web of material.

2. A reviewing and collating machine as recited in claim 1 wherein the reviewing surface comprises a translucent panel and means are provided for backlighting the translucent panel.

3. A reviewing and collating machine as recited in claim 1 further comprising skew adjustment means for shifting the position of one end of the takeup shaft to change the angle at which the web of material is wound on the takeup shaft.

4. A reviewing and collating machine as recited in claim 1 wherein the means for rotatably and removably mounting the takeup shaft comprise a pair of spaced apart cones rotatably mounted on the frame, at least one of the cones being rotated by the driving means and at least one of the cones being spring biased along a direction coaxial with the longitudinal axis of the takeup shaft.

5. A reviewing and collating machine as recited in claim 1 wherein the means for rotatably and removably mounting the supply shaft comprise a pair of spaced apart guide rails, mounted on the frame in a substantially horizontal position, and vertically extending, hook shaped stop members mounted on corresponding ends of each guide rail to engage the ends of the supply shaft.

6. A reviewing and collating machine as recited in claim 5 wherein the driving means include a driving gear rotatably mounted on the frame adjacent one of the hook shaped stop members and a corresponding gear is affixed to the end of the supply shaft adjacent the same hook shaped stop member such that the driving gear and the supply shaft gear are engaged when the supply shaft ends engage the hook shaped stop members.

7. A reviewing and collating machine as recited in claim 1 wherein the surface of the takeup shaft is electrically non-conductive and means are provided for electrostatically charging the non-conductive surface to prevent unraveling of the portion of the web of material wound thereon.

8. A reviewing and collating machine as recited in claim 1 wherein at least one of the self-centering pulleys comprises a cylinder mounted on the frame, the exterior surface of the cylinder having a circumferential, protruding ridge at its midsection and a plurality of helical, protruding ridges on either longitudinal side of the circumferential ridge, the ridges on one longitudinal side of the circumferential ridge being divergent with respect to the helical ridges on the other longitudinal side of the circumferential ridge in the direction of forward travel of the web of material from the supply roll to the batching roll, the exterior surface of each side of the pulley having a plurality of holes therein, and means for independently supplying gas under pressure to the holes in the surface of each longitudinal half of the pulley, the gas being supplied in equal amounts to each longitudinal half of the pulley.

9. A reviewing and collating machine as recited in claim 8 further comprising means for rotatably mounting the cylinder on the frame and wherein the helical pattern of the protruding ridges on the external surface of each radial half of the cylinder is a mirror image of the helical pattern on the external surface of the opposite radial half of the cylinder.

10. A reviewing machine as recited in claim 1 wherein the reviewing surface is positioned in the frame so as to allow open access to the reviewing surface by an operator of the machine for making corrections to the web of material.

* * * * *